United States Patent [19]

Gentile

[11] 4,375,759

[45] Mar. 8, 1983

[54] VARIABLE SPEED, SYNCHRONOUSLY OPERABLE, STOCK MATERIAL FEEDING AND FORMING APPARATUS

[75] Inventor: Patrick J. Gentile, Pittsburgh, Pa.

[73] Assignee: Vamco Machine & Tool, Inc., Pittsburgh, Pa.

[21] Appl. No.: 216,570

[22] Filed: Dec. 15, 1980

[51] Int. Cl.[3] ..... B21F 11/00

[52] U.S. Cl. ..... 72/131; 72/161; 83/40; 83/231; 83/236

[58] Field of Search ..... 83/236, 231, 40; 72/131, 160, 161

[56] References Cited

U.S. PATENT DOCUMENTS

| | | | |
|---|---|---|---|
| 2,272,215 | 2/1942 | Lockett et al. | 164/74 |
| 2,314,367 | 3/1943 | Pearson | 164/49 |
| 2,393,683 | 1/1946 | Hetzel et al. | 83/231 |
| 2,480,781 | 8/1949 | Simpson | 164/49 |
| 2,637,352 | 5/1953 | Reed et al. | 83/231 |
| 3,053,129 | 9/1962 | Aronson et al. | 83/236 |
| 3,102,673 | 9/1963 | Aronson et al. | 226/28 |
| 3,143,938 | 8/1964 | Aronson et al. | 93/63 |
| 3,244,045 | 4/1966 | Aronson et al. | 83/236 |
| 3,315,553 | 4/1967 | Handler et al. | 83/82 |
| 3,465,958 | 9/1969 | Gunderson et al. | 234/108 |
| 3,483,782 | 12/1969 | Eyberger | 83/202 |
| 3,768,349 | 10/1973 | Cauffiel | 83/42 |
| 3,802,307 | 4/1974 | Oggolan | 83/236 X |
| 3,978,703 | 9/1976 | Primich et al. | 72/131 |
| 4,138,913 | 2/1979 | Gentile | 83/236 |

*Primary Examiner*—Frank T. Yost

*Attorney, Agent, or Firm*—Stanley J. Price, Jr.; John M. Adams

[57] ABSTRACT

A pair of continuously driven pull rolls of stock puller supported on a table having a longitudinal bed engage a web of the stock material to continuously unreel the stock material from a coil. The pull rolls are rotated by a drive shaft that is coupled to an input shaft of a feed roll unit. The input shaft is continuously rotated by a pulley-belt drive connection from a common power shaft. Continuous rotation of the input shaft is converted to intermittent rotation of a feed roll that intermittently advances the stock material to a stock material forming device, such as a material stamping or punching unit followed by a material cutting unit. The stamping and cutting units also include input shafts that are drivingly connected by pulleys and continuous belts to the common power shaft. The common power shaft is continuously rotated by a pulley-belt drive connection from an output shaft of a variable speed DC motor supported by the table. The output speed of the motor shaft is adjustable to rotate the common power shaft at a preselected speed to vary the feed rate of the stock material to the stamping unit. The stamping unit, as well as the stock puller and cutting units, being connected to the common power shaft are responsive to a change in the feed rate to maintain the operation of these units synchronized with the material feeding operation.

12 Claims, 3 Drawing Figures

VARIABLE SPEED, SYNCHRONOUSLY OPERABLE, STOCK MATERIAL FEEDING AND FORMING APPARATUS

BACKGROUND OF THE INVENTION

1. Field of the Invention

This invention relates to apparatus for synchronously performing a plurality of operations on a web of stock material and more particularly to a light duty stamping machine in which a plurality of operations are performed on a web of stock material in timed, synchronous relation where a change in the rate of feed of the stock material to a stamping unit results in a change in the rate of operation of the other units to maintain the operation of all the units in timed relation.

2. Description of the Prior Art

It is the conventional practice in high speed automatic press operations to feed a strip of material from a coil to the dies of the press for punching, stamping, cutting or the like of a preselected length of the material from the web of stock material. The material must be fed to the stamping or punching unit in timed relation with the stamping or punching operation so that when the dies contact the material, the material is released from engagement by the feed rolls so that the feed is interrupted and the material is stationary relative to the dies. After the stamping or punching operation is completed, the feed roll unit is actuated to advance another preselected length of material at a preselected feed rate to the press. Therefore, the feeding of the stock material to the press must be coordinated with each operation whether it be stamping, punching, cutting or any other operation so that prior to each operation a new segment of the stock material is in correct register with the operation to be preformed.

In heavy duty stamping and pressing operations, as disclosed in U.S. Pat. No. 3,483,782, it is well known to drivingly connect the feed roll unit to the power punch press crankshaft. Continuous rotation of the crank shaft is converted by an index drive to non-continuous, incremental movement of an output shaft drivingly connected to a driven feed roll of the feed roll unit. With this arrangement the feed roll is not rotated during the stamping or pressing portion of the forming operation. After the punching or stamping operation is completed, the feed roll is rotated to advance another peselected length of stock material from a roll of stock material to the press dies. The feeding of stock material to the press is completed prior to the operation of forming the stock material by stamping, punching, or the like.

U.S. Pat. Nos. 2,272,215; 2,314,367; 2,480,781; 3,053,129; 3,102,673; 3,143,938; 3,244,045; 3,315,553; 3,768,349 and 3,978,703 disclose punching and stamping apparatus in which stock material is unreeled from a coil, stamped or punched, and cut into equal lengths of stamped stock material. The principal factor in feeding the stock material to the punch press in these devices in coordinating the feeding operation with the punching operation and the other operations performed on the stock material subsequent to the punching operation, such as cutting and stacking the final product.

When a plurality of motors for individually powering each of the stock forming devices are utilized considerable difficulty is encountered in synchronizing the feeding operation, for example, with the punching or stamping and cutting operations. When separate drive units are employed, a change in the feed rate necessitates a change in the rate of stamping the stock material and cutting preselected lengths of the stamped stock material from the web. Adjustments in the rate in which the individual operations are performed to maintain the operations synchronized generally requires considerable time and skill of an experienced technician.

U.S. Pat. No. 4,138,913 discloses a common drive for the punching operation and the feeding operation in a heavy duty punch press by drivingly connecting the feed roll unit to the punch press. In addition, a stock pulling unit is drivingly connected to the feed roll unit so that stock material is continuously unreeled from a roll and fed to the feed roll unit. The feed roll unit in timed relation with the cyclical movement of the punch press dies intermittently feeds preselected lengths of the stock material to the punch press. During the punching operation, rotation of the feed roll is interrupted and the stock pulling unit continues to unreel lengths of stock material from the reel. Thus a loop is formed in the stock material between the stock pulling unit and the feed roll unit. At the end of each punching cycle, the material formed in the loop is fed by the feed roll unit to the punch press.

U.S. Pat. Nos. 2,314,367; 2,272,215; 2,480,781 and 3,053,129 also disclose a single drive motor to provide both continuous unreeling from a coil and intermittent feeding to a punch press. In addition, U.S. Pat. No. 3,465,958 discloses a standard Geneva drive coupled to a continuously rotating input shaft for converting the continuous rotary motion of an output shaft to intermittent rotary motion ot effect stepped advancement of cards to be punched with holes. The same continuous drive shaft is coupled by eccentrics to the punches at each punch position whereby a selected punch is oscillated at right angles to the path of movement of the card to achieve penetration during dwell of the feed mechanism.

While it has been suggested by the prior art devices to drivingly connect a stock pulling unit and an intermittent feed unit to the drive of a punch press there is need to provide a stock material forming apparatus that utilizes a single source of power for operating a plurality of stock material forming devices such as a stock pulling unit, a feed roll unit, a stamping or punching unit, a cutting unit, and the like where the rate of operation of any of the units can be varied such as the feed unit and the rates of operation of the other units change automatically so that all the operations performed on the stock material are maintained in timed, synchronous relation.

SUMMARY OF THE INVENTION

In accordance with the present invention there is provided apparatus for synchronously performing a plurality of operations on a web of stock material that includes pull means for continuously pulling the stock material from a source. A stock material forming device is positioned downstream of the pull means. Intermittent feed means intermittently feeds a preselected length of the stock material to the stock material forming device. The intermittent feed means is positioned between the pull means and the stock material forming device. A power means is drivingly connected to an output shaft and continuously rotates the output shaft at a preselected speed. A common power shaft is positioned adjacent to the intermittent feed means and the stock material forming device. Drive connecting means drivingly connects the output shaft to the common power shaft to continuously rotate the common power shaft. First drive means drivingly connects the common power shaft to the intermittent feed means to convert continuous rotation of the common power shaft to intermittent rotation of the intermittent feed means for intermittently feeding at a preselected feed rate a preselected length of the stock material to the stock material forming device. Second drive means drivingly connects the common power shaft to the stock material forming device. The stock material forming device and the intermittent feed means are connected to each other through the common power shaft so that the stock material forming device operates synchronously in timed relation with the intermittent feed means. A drive shaft extends between and drivingly connects the intermittent feed means and the pull means for actuating the pull means to continuously advance the stock material from the source to the intermittent feed means for feeding to the stock material forming device in timed relation to the operation of the stock material forming device on the stock material.

The pull means, the intermittent feed means, and the stock material forming device are positioned on and secured to the upper surface of a unitary frame. A reel of the stock material is positioned at one end of the frame, and the pull means unreels the stock material from the reel. A delivery station is positioned at the opposite end of the frame and is operable to receive the finished stock material after it has passed through the stock material forming device and any other subsequent device, such as a material cut off unit positioned downstream of the forming device.

The respective units that perform an operations on the stock material are positioned in spaced longitudinal relationship on the stationary frame between the reel and a delivery station. With this arrangement a plurality of sequential operations are performed in timed relation on the stock material. The stock material is conveyed longitudinally on the stationary frame from the reel to the delivery station.

The power means is preferably a variable speed direct current motor also supported by the unitary frame. The motor is operable to rotate the output shaft at a preselected continuous rate of rotation. The drive means for drivingly connecting the output shaft to the common power shaft preferably includes a first pulley nonrotatably connected to the output shaft and a second pulley nonrotatably connected to the common power shaft. A continuous flexible member, such as a belt, reeved about the first and second pulleys transmits rotation from the output shaft to the common power shaft.

Each of the respective stock material forming devices, such as a feed roll unit, a stamping or punching unit, a material cutting unit, and the like, include input shafts having pulleys nonrotatably connected thereto. The second drive means for drivingly connecting the common power shaft to these stock material forming devices includes a pulley corresponding to each unit nonrotatably connected to the common power shaft. The pulleys on the common power shaft are then drivingly connected by continuous flexible members, such as belts, to the respective input shafts.

Thus with this arrangement, continuous rotation of the common power shaft at a preselected speed, as determined by the rotational speed of the motor output shaft, is transmitted by the continuous belts to the input shafts of the intermittent feed unit, the punch or stamping unit, the material cutting unit, and the like. The various operating units perform individual operations on the stock material in timed relation with the other operations being performed and particularly with the upstream operation or operations performed on the stock material.

Continuous rotation of the common power shaft is converted to intermittent rotation of a driven feed roll of the feed unit. The input shaft of the feed unit rotates at a continuous speed and is coupled to the drive shaft that actuates the stock pulling unit. Thus the stock pulling unit unreels stock material from the reel and feeds the stock material to the feed unit in synchronism with the feeding of the stock material to the stamping or punching device. The feed unit intermittently feeds preselected lengths of the stock material at a preselected rate to preferably either a stamping or punching device. The amount or length of material fed by the pulling unit to the feed unit corresponds to the length of material fed by the feed unit to the stamping or punching device.

By changing the speed of the DC motor, the rate of rotation of the common power shaft is changed. Thus if the rate of rotation of the common shaft is increased, the rate of rotation of each of the input shafts of the various operating units which are drivingly connected to the common power shaft by continuous belts is increased. In this manner if the rate of feed of stock material to the material stamping unit is increased, the rate of rotation of the input shaft to the cutting unit is increased to increase the rate of cutting of the stock material in response to a change in the stock material feed rate. Thus by connecting the other operating units to the source of drive of the variable feed unit, a change in the feed rate will result in a corresponding change in the rate of operation of the other devices so that the sequence of operations performed on the stock material is maintained in timed relation.

Further in accordance with the present invention there is provided a method for synchronously performing a plurality of operations on a web of stock material. It includes the steps of continuously pulling the stock material from a source. A preselected length of the stock material is intermittently fed to a stock material forming device. A preselected material forming operation is performed on the stock material. A common power shaft is continuously rotated at a preselected speed. Continuous rotation of the common power shaft is converted to intermittent rotation for intermittently feeding at a preselected feed rate a preselected length of the stock material for a material forming operation. The common power shaft is drivingly connected to a device for performing a material forming operation on the stock material. A material forming operation is synchronously performed on the stock material in timed relation with the intermittent feeding of a preselected length of the stock material. The common power shaft is drivingly connected through the feed unit to means for continuously pulling the stock material from the source. The stock material is continuously advanced from the source for intermittent feeding to the device for performing the material forming operation on the stock material in timed relation to the material forming operation on the stock material.

Accordingly, the principal object of the present invention is to provide apparatus for synchronously peforming a plurality of operations on a web of stock material in which each operation is performed by a device that receives power from a common source so that each of the devices is drivingly connected in timed relation to each other.

Another object of the present invention is to provide a light duty stamping machine for performing a plurality of operations on a web of stock material in which the stock material is intermittently fed to a stamping device by a drive connection from a common power source which is also operatively connected to the stamping device so that an increase in the feed rate to the stamping device results in an increase in the rate of the stamping operation.

Another object of the present invention is to provide a method and apparatus for carrying out a plurality of material forming operations on a web of stock material continuously unreeled from a roll where each operation is sequentially performed with respect to the other operations and the various devices for performing the operations are drivingly connected to one another so that a change in the rate of operation of one device results in a corresponding change in the rate of operation of the other devices so that all of the devices operate in timed relation.

These and other objects of the present invention will be more completely disclosed and described in the following specification, the accompanying drawings, and the appended claims.

DESCRIPTION OF THE PREFERRED EMBODIMENT

Figures 1, 2, 3:
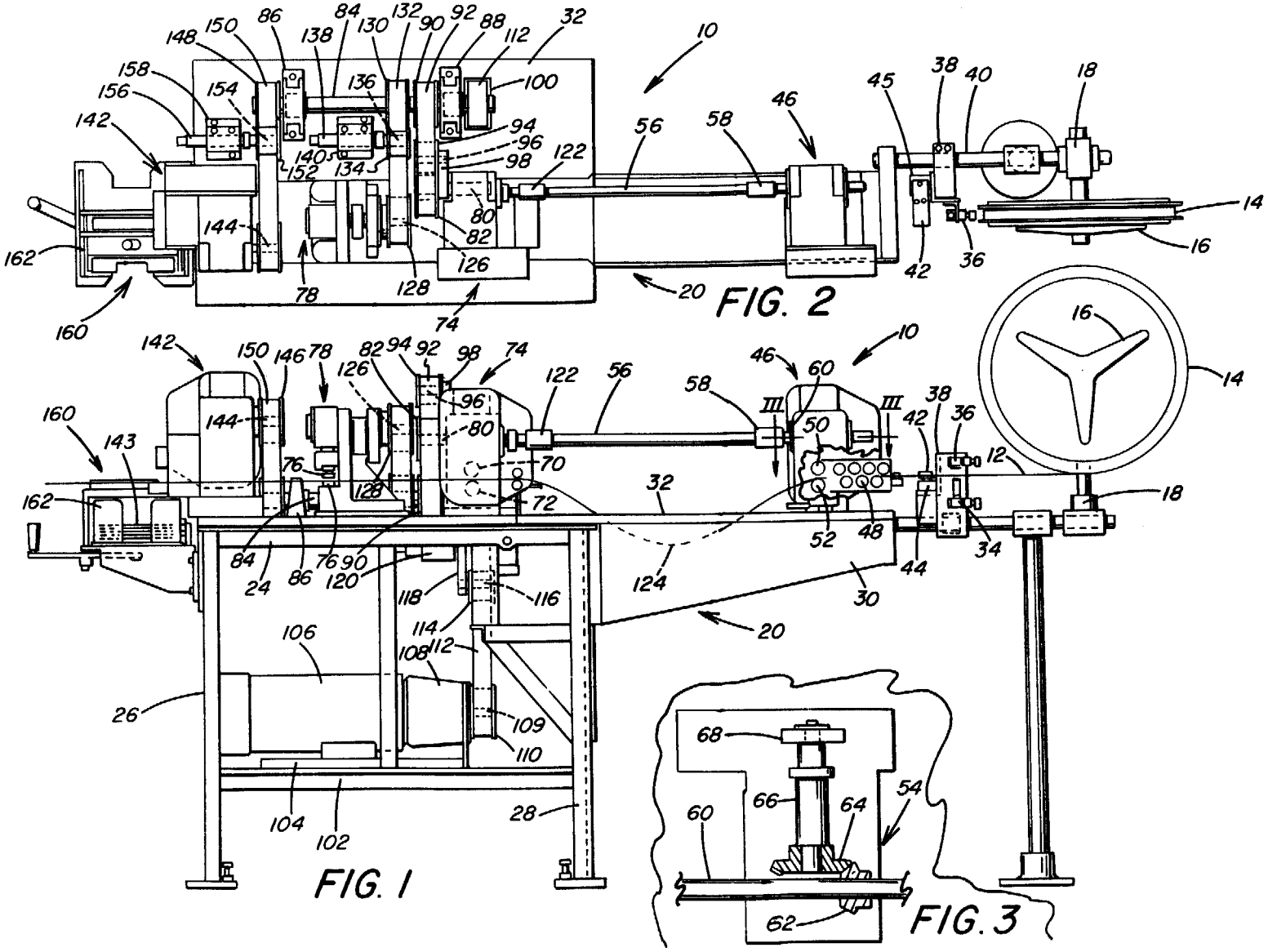
FIG. 1 is a view in side elevation of apparatus for performing a plurality of operations on a web of stock material continuously unreeled from a coil, illustrating a plurality of devices drivingly connected to a common drive so that the devices are operated in timed relation with each other.
FIG. 2 is a top plan view of the apparatus shown in FIG. 1, illustrating a common power shaft drivingly connected by endless belts to the plurality of material forming devices.
FIG. 3 is a sectional view taken along line III—III FIG. 1, illustrating the drive connection between a drive shaft and an input shaft that drives a stock puller that continuously unreels stock material from the coil.

Referring to the drawings and particularly to FIGS. 1 and 2, there is illustrated apparatus generally designated by the numeral 10 for performing a plurality of operations on a web of stock material 12 that is continuously unreeled from a coil 14 of the stock material. The coil 14 is supported by a reel 16 that is, in turn, rotatably mounted on a support 18 secured to one end of a frame generally designated by the numeral 20 for supporting the apparatus 10. The frame 20 includes at the end adjacent the reel 16 a floor support 22 and at the opposite end of the frame 20 a table 24 which is also supported on a floor by legs 26 and 28. A support bracket 30 is secured at one end to the table 24 and at the opposite end to the support 18 for the reel 16. With this arrangement, the support bracket 30 and the table 24 form an upper horizontal surface or bed 32 upon which a plurality of devices comprising the apparatus 10 are positioned for carrying out synchronously, in timed relation a plurality of material forming operations on the web of stock material 12 as it is unreeled from the coil 14.

The stock material is unreeled from the coil and is advanced between a light source 34 and a light sensor 36 that is mounted by a bracket 38 on a bar 40 connected to the reel support 18. After the web of stock material passes between the light source 34 and the light sensor 36 the stock material passes through an actuator 42 that is supported by a rotary shaft 45 of a rotary type micro-switch 44. the switch 44 is connected to the mounting bracket 38. Thereafter, the web of stock material passes through a combination coil straightener and stock puller generally designated by the numeral 46.

The combination light source 34 and sensor 36 and the micro-switch 44 are well known in the art as safety devices that permit only stock material of a preselected thickness to be fed to the various stock material forming devices of the apparatus 10. For example, if the stock material is electrical leadframe material containing welded or taped joints and if the welded or taped joints exceed a preselected thickness, then the impermissible thickness is detected by interruption of the light ray between the source 34 and sensor 36 or causing rotation of the shaft 45 to trip the micro-switch 44. In either instance the source of power for unreeling the stock material is stopped in order to take the necessary corrective action to prevent damage to the various operating devices of the apparatus 10. The combination light source 34 and light sensor 36 and micro-switch 44 are beyond the scope of the present invention and therefore will not be discussed in further detail.

The combination roll straightener and stock puller 46 includes a plurality of horizontally positioned, longitudinally spaced, overlying rolls 48 that are operable to straighten out the stock material 12 as it is unreeled from the coil 14. The cover of the stock puller 46 illustrated in FIG. 1 has been broken away to more clearly disclose the rolls 48. Also associated with the device 46 downstream of the straightener rolls 48 is a pair of pull rolls 50 and 52. Preferably, roll 50 is a driven pull roll and roll 52 is an idler pull roll. The pull rolls 50 and 52 are positioned so as to catch the stock material 12 between the rolls. The driven pull roll 50 is continuously rotated so that the stock material is continuously unreeled at a preselected rate from the coil 14 of the stock material.

The pull roll 50 is continuously driven by a drive connection generally designated by the numeral 54 illustrated in FIG. 3. A drive shaft 56 driven at a continuous rate of rotation, as will be explained later in greater detail, is drivingly connected through the drive connection 54 to the pull roll 50. The drive shaft 56 is connected by a coupling 58 to an input shaft 60, illustrated in FIG. 3, that extends between the coupling 58 and the combination roll straightener stock puller 46. The uniform, continuous rotation of the drive shaft 56 is transmitted through the coupling 58 to the input shaft 60.

The uniform, continuous rotation of the input shaft 60 is transmitted to the driven pull roll 50 by the drive connection 54. The drive connection 54 includes a first bevel gear 62 nonrotatably secured to the input shaft 60 and a second bevel gear 64 that is arranged in meshing relation with the bevel gear 62. The second bevel gear 64 is nonrotatably secured to one end portion of output shaft 66. The output shaft 66 is rotatably supported by the unit 46. A first reduction gear 68 is nonrotatably secured to the opposite end of the output shaft 66 and meshes with one of a plurality of reduction gears comprising a reduction gear train (not shown) in which the last reduction gear of the gear train is nonrotatably connected to one end portion of a shaft that rotates the driven pull roll 50.

The drive shaft 56 transmits uniform, continuous rotary motion to the output shaft 66 to continuously rotate the driven pull roll 50 at a preselected speed. With the stock material caught between the rolls 50 and 52, continuous rotation of the roll 50 continuously advances stock material from the coil 14. The idler pull roll 52 may be secured to a lever arm or a pivoting member that is connected to the end of a piston rod of a piston cylinder assembly (not shown) for moving the idler pull roll 52 into and out of contact with the stock material.

While the pull rolls 50 and 52 rotate continuously to unreel stock material from the coil 14, a pair of feed rolls 70 and 72 of a feed roll unit generally designated by the numeral 74 intermittently feed a preselected length of the stock material into position relative to dies 76 of a punching or stamping unit generally designated by the numeral 78. The stamping unit is positioned downstream of the feed roll unit 74 on the horizontal bed 32.

The feed roll unit 74 includes an input shaft 80, and a drive input pulley 82 nonrotatably secured to the end of the input shaft 80. A common power line shaft 84 is rotatably supported by a pair of pillow blocks 86 and 88 on the horizontal bed 32 of table 24 in spaced parallel relation to the input shaft 80. A timing pulley 90 is nonrotatably secured to the common power line shaft 84 oppositely of the drive input pulley 82. An endless belt 92 is reeved about the pulleys 82 and 90 to drivingly connect the pulley 90 to the pulley 82. With this arrangement, rotation of the common power line shaft 84 is transmitted to the input shaft 80. An idler pulley 94 is positioned in contact with one surface of the belt 92 and is mounted on a shaft 96 secured to an idler arm 98 extending from the housing of the unit 74. With this arrangement, the position of the idler pulley 94 can be adjusted to exert a preselected tension on the belt 92.

A geared cam drive (not shown) of the feed roll unit 74 drivingly connects the input shaft 80 to the driven feed roll 70. The driven feed roll 70 is positioned in overlying relation with the idler feed roll 72 which is rotatably supported by the feed roll unit 74. The idler feed roll 72 may also be secured to a lever arm or a pivoting member that is connected to the end of a piston rod of a piston cylinder assembly for moving the idler pull roll 52 into and out of contact with the stock material.

The geared cam drive for connecting the input shaft 80 to the driven feed roll 70 is beyond the scope of the present invention and therefore will not be described herein in detail. U.S. Pat. No. 4,138,913 discloses a suitable geared cam drive for converting uniform, continuous rotation of the input shaft 80 to non-continuous intermittent rotation of the driven feed roll 70. Thus, the feed rolls 70 and 72 intermittently advance preselected lengths of the stock material 12 to the punching or stamping unit 78 in timed relation with the punching or stamping operation. Thus, each time the dies 76 of the punching or stamping unit 78 are actuated another length of the stock material is fed for positioning between the dies 76.

Referring to FIG. 2, the common power line shaft 84 has a timing pulley 100 nonrotatably connected to the end of the shaft 84 adjacent the pillow block 88. The common shaft 84 is not illustrated in FIG. 1 but it should be understood that the shaft 84 is supported by the pillow blocks 86 and 88 on the horizontal bed 32 of the table 24.

The table 24 also includes a lower horizontal bed 102, and a motor mounting plate 104 is positioned on and secured to lower horizontal bed 102. A power device, such as a motor 106, is secured to and positioned on the mounting plate 104. Preferably the motor 106 is a variable speed direct current motor in the range of 3 horsepower and capable of generating 1700 revolutions per minute. The motor can also be an alternating current motor and can be of a preselected horsepower. The motor 106 includes a clutch and brake 108 and an output shaft 109 that is drivingly connected to a pulley 110. An endless belt 112 is reeved about the pulleys 110 and 100 to drivingly connect the pulley 110 to the pulley 100. The pulleys are preferably provided with means, such as teeth, which engage the belts, to prevent slippage of the belt on the respective pulley.

The endless belt 112 extends through a suitable opening provided in the upper horizontal bed 32. A preselected tension is maintained on the endless belt 112 by an idler pulley 114 that is positioned on an idler shaft 116 that is, in turn, supported by an idler arm 118. The idler arm 118 is suitably connected to a block 120 that is secured to the table 24. With this arrangement, rotation of the motor output shaft 109 and the pulley 110 is transmitted to the common power line shaft 84.

The continuous rotation of the common power line shaft 84 at a preselected speed is transmitted by the belt 92 to the input shaft 80 of the feed roll unit 74. As above-discussed, the continuous rotation of the input shaft 80 of the feed roll unit 74 is converted to non-continuous, intermittent rotation of the driven feed roll 70 by a conventional geared cam drive so that the feed rolls 70 intermittently advance preselected lengths of the stock material to the stamping or punching unit 78 that is positioned downstream of the feed roll unit 74 on the upper horizontal bed 32.

Further in accordance with the present invention the uniform continuous rotation of the input shaft 80 of the feed roll unit 74 is transmitted through a coupling 122 to the drive shaft 56 that, as above-described, is drivingly connected to the combination roll straightener and stock puller 46. Thus the drive shaft 56 extends between and connects the drive of the feed roll unit input shaft 80 through the coupling 58 to the input shaft 60 of the stock pulling unit 46. The driven pull roll 50 is continuously rotated by the drive connection 54 illustrated in FIG. 3 to continuously advance the stock material 12 from the coil 14 to the feed roll unit 74 for feeding the stock material to the stamping or punching unit 78 in timed relation to the operation of stamping or punching preselected lengths of the stock material.

While the pull rod 50 and 52 rotate continuously to unreel the stock material 12 from the coil 14, the feed rolls 70 and 72 intermittently feed stock material of equal lengths into stamping position relative to the dies 76 of the stamping unit 78. During the stamping operation the intermittently driven feed rolls 70 and 72 interrupt advance of the stock material to the stamping unit 78; however, the continuously driven pull roll 50 and the idler pull roll 52 continue to unreel the stock material 12 from the coil 14. Consequently, an arcuate portion or loop 124 is formed in the stock material between the stock pulling unit 46 and the feed roll unit 74 during the stamping operation. The loop 124 has the configuration as illustrated in FIG. 1.

The pull rolls 50 and 52 continuously feed the stock material during the stamping operation; while, the feed rolls 70 and 72 interrupt feed of the stock material so that the loop 124 is formed during the stamping operation. After the stamping operation, the dies 76 are retracted, and in timed relation therewith the geared cam drive of the feed roll unit 74 actuates the feed rolls 70 and 72 to rotate and advance from the loop 124 the next segment length of the stock material 12 to be stamped into position in the stamping unit 78. At the end of each feeding cycle subsequent to the next stamping operation, substantially all of the material stored in the loop is fed to the unit 78. The stock material assumes a substantially horizontal position beneath the drive shaft 56 between the units 46 and 74 with a limited amount of slack present in the section of the stock material between the units 46 and 74.

The amount or quantity of the stock material 12 fed to the stamping unit 78 is controlled by the periodic interval of rotation of the driven feed roll 70 and the rate of rotation of the feed roll 70 and thus the gear ratio of the gears comprising the feed roll unit 74. The interval of rotation and the rate of rotation of the feed roll 70 is also variable by making adjustments in the speed of the motor 106. In addition the rate of rotation of the driven feed roll 70 can be varied by making adjustments to the geared cam drive of the feed roll unit 74. The relative rate of rotation of the feed rolls 70 and 72 and the pull rolls 50 and 52 is synchronized so that, the feed rolls 70 and 72 advance the stock material at a rate equal to the rate of advancement of the stock material by the pull rolls 50 and 52. At the end of each feeding cycle all material forming the loop 124 is fed to the stamping unit 78. This assures that for each stamping operation the same length of stock material is fed to the stamping unit 78. This operation is illustrated and described in greater detail in U.S. Pat. No. 4,138,913.

The material stamping unit 78 is also supported on the horizontal bed 32 of the table 24 and includes an input shaft 126 that is drivingly connected in a conventional manner to the stamping dies 76. A timing pulley 128 is nonrotatably connected to the input shaft 126. A timing pulley 130 is positioned on the common power line shaft 84 downstream of the timing pulley 90 and is nonrotatably connected to the shaft 84. An endless belt 132 is reeved about the pulleys 128 and 130. With this arrangement, uniform, continuous rotation of the common power line shaft 84 is transmitted to the input shaft 126 of the stamping unit 78. Also an idler pulley 134 is positioned in abutting relation with the endless belt 132 to apply a preselected tension on the belt 132. The idler pulley 134 is mounted on an idler shaft 136 that is, in turn, connected to an idler arm 138 that is supported on the horizontal bed 32 by a clamp block 140.

By drivingly connecting the stamping unit 78 to the common power line shaft 84, the rate of operation of each stamping cycle is determined by the rate of rotation of the common power line shaft 84. As above-discussed, the rate of rotation of the common power line shaft 84 is determined by the output speed of the motor 106. In the embodiment where the motor 106 is a variable speed motor, the output speed of the motor is variable so that the rate of rotation of the common power line shaft 84 is also variable.

By connecting the stock puller 46 through the feed roll unit 74 to the shaft 84 and by connecting the feed roll unit 74 and the stamping unit 78 directly to the common power line shaft 84, a change in the rate of rotation of the common power line shaft 84 results in a change in the rate of operation of pulling the stock material 12 from the reel 14, intermittently feeding the stock material to the stamping dies 76, and operation of the stamping dies 76 to stamp or punch the stock material. By directly connecting the common power line shaft 84 to the respective input shafts of the units 74 and 78 and the unit 74 to the unit 46, the respective units 46, 74, and 78 are connected to each other for synchronous timed operation. Thus the feed roll unit 74 feeds a preselected length of stock material to the stamping unit 78 in timed relation to the operation of the dies 76 to stamp or punch the stock material.

By directly connecting the input shafts of each of the respective units 74 and 78 to the common power line shaft 84 and by connecting the input shaft of unit 46 through the input shaft of unit 74 to shaft 84, the respective units 46, 74, and 78 are operated in timed relationships with each other. For example, the feed rolls 70 and 72 are operable to intermittently feed six inch increments of one inch wide electrical leadframe material to the stamping unit 78 during the interval when the dies 76 are removed from contact with the surface of the material. There is no intermittent feeding of the material to the stamping unit 78 during the stamping operation.

The rate of rotation of the common power line shaft 84 is determined by the rate of rotation of the motor output shaft 109. As above discussed, the motor 106 can be either a variable speed AC or DC motor. With this arrangement the rate of rotation of the common power line shaft 84 is selective. Thus by increasing the rate of rotation of the common power line shaft 84, the rate of intermittent feed of the leadframe material to the stamping unit 78 is increased. Because the feed roll unit 74 and the stamping unit 78 are both connected directly to the common power line shaft 84, the rate of each stamping cycle performed by the stamping unit 78 is adjusted in response to a change in the feed rate of the material to the stamping unit 78. In this manner the operations of the feed roll unit 74 and the stamping unit 78, as well as, stock pulling unit 46 remain in timed, synchronous relation.

It should also be understood that other material forming operations may be performed on the stock material in addition to those operations discussed above. Similarly these additional operations can be performed by devices that are also drivingly connected to the common power line shaft 84. Thus the additional devices can be carried out in timed, synchronous relation with the other operations performed on the web of stock material. For example, an intermittent material cutting unit 142 is shown positioned downstream of the stamping unit 78 on the horizontal bed 32. The intermittent material cutting unit 142 is operable to cut or sever the stock material as it is fed from the stamping unit 78. The stock material is intermittently cut to form individual segments of the stock material each having an equal length. The individual segments 143 are assembled in a stacked arrangement, as illustrated in FIG. 1.

The intermittent material cutting unit 142 includes an input shaft 144 that is drivingly connected to the severing devices (not shown) of the unit 142 that engage the stock material to cut the web of stock material into individual segments 143 of equal length. The input shaft 144 is nonrotatably connected to a timing pulley 146. As illustrated in FIG. 2, a pulley 148 is nonrotatably connected to the common power line shaft 84 adjacent the pillow block 86 at a point opposite the timing pulley 146 on the input shaft 144. An endless belt 150 is reeved about the pulleys 146 and 148 to drivingly connect the pulley 146 to the pulley 148. With this arrangement rotation of the common power line shaft 84 is transmitted to the input shaft 144.

In addition an idler pulley 152 is positioned in contact with the endless belt 150 to apply a preselected tension on the belt 150. The idler pulley 152 is mounted on an idler shaft 154 that is connected to an idler arm 156. The idler arm is supported by a clamping block 158 that is secured to the horizontal bed 32. The position of the idler pulley 152, as well as, the position of the other pulleys discussed above, is adjustable to, in turn, adjust the tension in the respective belts that drivingly connect the common power line shaft 84 to the respective input shafts of the feed roll 74 and the stamping unit 78.

By drivingly connecting the intermittent material cuting unit 142 to the common power line shaft 84, a change in the rate of feed of the stock material to the stamping unit 78 results in a change in the rate of cutting the stock material into individual segments 143 by the unit 142. The operation of cutting the stock material into individual segments is thus maintained in timed, synchronous relation with the other operations performed on the stock material.

The individual segments 143 of stock material are fed to a delivery station generally designated by the numeral 160. At the delivery station 160 the individual segments are vertically stacked in a container 162 that is connected to the table 24. However, it should be understood that the stock material following the stamping operation may be fed to a unit for rereeling the stock material as opposed to a unit for cutting the stock material into individual segments. The unit for rereeling the stock material is preferably powered and drivingly connected by pulleys and a continuous belt in the manner above described for the operating units 74, 78, and 142 to the common power line shaft 84.

According to the provisions of the patent statutes, I have explained the principle, preferred construction, and mode of operation of my invention and have illustrated and described what I now consider to represent its best embodiment. However, it should be understood that, within the scope of the appended claims, the invention may be practiced otherwise than as specifically illustrated and described.

I claim:

1. Apparatus for synchronously performing a plurality of operations on a web of stock material comprising, a frame having a bed, pull means positioned on said bed for continuously pulling the stock material from a source, a stock material forming device positioned downstream of said pull means on said bed, intermittent feed means for intermittently feeding a preselected length of the stock material to said stock material forming device, said intermittent feed means being positioned on said bed between and spaced from said pull means and said stock material forming device, said pull means, said stock material forming device, and said intermittent feed means being positioned in spaced longitudinal relation on said bed in alignment with the direction of feed of the stock material on said bed, an output shaft positioned opposite said bed, power means drivingly connected to said output shaft for continuously rotating said output shaft at a preselected speed, a common power shaft positioned on said bed in spaced parallel relation with the direction of feed of the stock material on said bed and closely adjacent to said intermittent feed means and said stock material forming device, drive connecting means for drivingly connecting said output shaft to said common power shaft to continuously rotate said common power shaft, first drive means for directly drivingly connecting said common power shaft to said intermittent feed means to convert continuous rotation of said common power shaft to intermittent rotation of said intermittent feed means for intermittently feeding at a preselected feed rate, a preselected length of the stock material to said material forming device, second drive means spaced longitudinally from said first drive means on said common power shaft for directly drivingly connecting said common power shaft to said stock material forming device, said first and second drive means extending in spaced parallel relation to one another between said common power shaft and said intermittent feed means and said stock material forming device respectively, said stock material forming device and said intermittent feed means being connected to each other by the common drive connection to said common power shaft so that said stock material forming device operates synchronously in timed relation with said intermittent feed means, and a drive shaft positioned in spaced parallel relation to said common power shaft and extending between and drivingly connecting said intermittent feed means and said pull means for actuating said pull means to continuously advance the stock material from the source to said intermittent feed means for feeding to said stock material forming device in timed relation to the operation of said stock material forming device on the stock material.

2. Apparatus for synchronously performing a plurality of operations on a web of stock material as set forth in claim 1 which includes, a plurality of operating devices for treating the stock material, and said operating devices being positioned in a preselected sequence in alignment with the direction of feed of the stock material on said bed and each directly drivingly connected to said common power shaft to perform sequential operations on the stock material in timed relation with the operations performed by said pull means, said stock material forming device, and said intermittent feed means.

3. Apparatus for synchronously performing a plurality of operations on a web of stock material as set forth in claim 1 which includes, a reel of the stock material supported above said bed at one end of said frame, a delivery station for receiving finished stock material positioned at an opposite end of said frame, said reel and said delivery station being aligned with the direction of feed of the stock material on said bed, said pull means, said intermittent feed means, and said stock material forming device being positioned between said reel and said delivery station for performing a plurality of sequential operations in timed relation on the stock material being conveyed longitudinally from said reel to said delivery station.

4. Apparatus for synchronously performing a plurality of operations on a web of stock material as set forth in claim 1 which includes, means mounted on said bed for rotatably supporting said common power shaft in spaced parallel relation adjacent to said intermittent feed means, said power means being positioned adjacent to said common power shaft, and said drive connecting means including a continuous flexible member drivingly connected to said output shaft and said common power shaft for continuously transmitting rotation of said output shaft to said common power shaft.

5. Apparatus for synchronously performing a plurality of operations on a web of stock material as set forth in claim 1 which includes, a pulley nonrotatably connected to said output shaft, a pulley nonrotatably connected to said common power shaft, and said drive connecting means including a continuous flexible member reeved about said pulleys to provide a right angle drive for directly transmitting rotation of said output shaft to said common power shaft.

6. Apparatus for synchronously performing a plurality of operations on a web of stock material as set forth in claim 1 in which, said intermittent feed means includes an input shaft, said stock material forming device including an input shaft, and rotation transmitting means for drivingly connecting said intermittent feed means input shaft and said stock material forming device input shaft to said common power shaft to rotate said respective input shafts in timed relation to each other for a preselected rate of rotation of said common power shaft.

7. Apparatus for synchronously performing a plurality of operations on a web of stock material as set forth in claim 1 in which, said stock material forming device includes a stamping mechanism, a material cutting mechanism positioned downstream of said stamping mechanism for cutting the stock material into segments of equal length, third drive means for drivingly connecting said common power shaft to said material cutting mechanism, said common power shaft being rotatable at a preselected speed so that a change in the rate of rotation of said common power shaft changes the rate of feed of the stock material to said stamping mechanism, and said stamping mechanism and said material cutting mechanism being responsive to a change in the rate of feed of the stock material to change the rate of stamping and cutting the stock material.

8. Apparatus for synchronously performing a plurality of operations on a web of stock material as set forth in claim 1 in which, said power means includes a variable speed motor, said motor being operable to rotate said common shaft through said output shaft at a preselected speed to vary the feed rate of the stock material to said stock material forming device, and said stock material forming device being responsive to a change in the feed rate to maintain the material forming operation synchronized with the feeding operation.

9. Apparatus for synchronously performing a plurality of operations on a web of stock material as set forth in claim 1 in which, said pull means includes a pair of rolls driven at a preselected speed in timed relation to the feeding of the stock material to said stock material forming device, and means associated with said pull rolls for straightening the web of stock material being unreeled from a coil to said pull means.

10. A method for synchronously performing a plurality of operations on a web of stock material comprising the steps of:

continuously pulling the stock material from a source, intermittently feeding a preselected length of the stock material along a preselected direction of feed to a stock material forming device, performing a preselected material forming operation on the stock material, continuously rotating a common power shaft at a preselected speed, rotatably supporting the common power shaft adjacent to the moving web of stock material in parallel relation to the direction of feed of the stock material, converting continuous rotation of the common power shaft to intermittent rotation for intermittently feeding at a preselected feed rate a preselected length of the stock material for a material forming operation, drivingly connecting the common power shaft from a first point on the common power shaft to a device for performing a material forming operation on the stock material, synchronously performing a material forming operation on the stock material in timed relation with the intermittent feeding of a preselected length of the stock material, drivingly connecting the common power shaft from a second point on the common power shaft through a material feed unit to means for continuously pulling the stock material from the source, and continuously advancing the stock material from the source for intermittent feeding to the device for performing a material forming operation on the stock material in timed relation to the material forming operation on the stock material.

11. A method for synchronously performing a plurality of operations on a web of stock material as set forth in claim 10 which includes, varying the rate of rotation of the common power shaft to vary the rate of feed of the stock material to the stock material forming device, and adjusting the rate of performing the material forming operation in response to a chage in the rate of feed to maintain the feeding and forming operations in timed relation.

12. A method for synchronously performing a plurality of operations on a web of stock material as set forth in claim 10 which includes, adjusting the rate of feed of the stock material to the stock material forming device, and adjusting the rate of pulling the stock material from the source in response to a change in the rate of feed so that the operations of feeding the stock material to the stock material forming device and pulling the stock material from the source are performed in timed, synchronous relation.

* * * * *